United States Patent [19]

Hatwar et al.

[11] Patent Number: 4,895,592

[45] Date of Patent: Jan. 23, 1990

[54] HIGH PURITY SPUTTERING TARGET MATERIAL AND METHOD FOR PREPARING HIGH PURITY SPUTTERING TARGET MATERIALS

[75] Inventors: Tukaram K. Hatwar; Paul D. Askins, both of Rochester, N.Y.

[73] Assignee: Eastman Kodak Company, Rochester, N.Y.

[21] Appl. No.: 133,599

[22] Filed: Dec. 14, 1987

[51] Int. Cl.[4] ..... C22B 4/00

[52] U.S. Cl. ..... 75/10.14; 75/10.18; 75/84 R; 75/148; 75/30; 75/420; 75/83; 75/129; 75/590

[58] Field of Search ..... 75/10.14, 84, 10.18; 420/83, 129, 590; 148/301, 302, 103

[56] References Cited

U.S. PATENT DOCUMENTS

| | | | |
|---|---|---|---|
| 3,775,091 | 11/1973 | Clites | 75/10.18 |
| 4,089,706 | 5/1978 | Zeiringer | 148/2 |
| 4,159,891 | 7/1979 | Schmidt et al. | 432/264 |
| 4,243,420 | 4/1979 | Sakai et al. | 106/38.3 |
| 4,297,388 | 10/1981 | Kumar et al. | 427/47 |
| 4,424,853 | 1/1983 | Khandros et al. | 164/57.1 |
| 4,580,617 | 4/1986 | Blechner et al. | 164/493 |
| 4,619,695 | 10/1986 | Oikawa | 75/84 |
| 4,647,548 | 3/1987 | Klein | 501/134 |
| 4,670,316 | 6/1987 | Kryder | 428/64 |
| 4,674,559 | 6/1987 | Schultheiss | 164/507 |
| 4,695,427 | 9/1987 | Degawa | 75/84 |
| 4,786,319 | 11/1988 | Zeiringer | 75/84 |

FOREIGN PATENT DOCUMENTS

| | | |
|---|---|---|
| 47-050487 | 10/1972 | Japan . |
| 48-025864 | 1/1973 | Japan . |
| 54-026923 | 2/1979 | Japan . |
| 54-136527 | 10/1979 | Japan . |
| 57047550 | 3/1980 | Japan . |
| 56-122662 | 9/1981 | Japan . |
| 57-085634 | 5/1982 | Japan . |
| 59-027747 | 2/1984 | Japan . |
| 59-104244 | 6/1984 | Japan . |
| 8002279 | 10/1981 | Sweden . |
| 616042 | 7/1978 | U.S.S.R. . |
| 990402 | 1/1983 | U.S.S.R. . |

OTHER PUBLICATIONS

Lasday, S. B., "Ceramic Refractory Coatings—Their Application and Performance", Ind. Heat., vol. 69, No. 12, pp. 38–40, (12/82), (abstract only).

Lasday, S. B., "Nature of Ceramic Coatings and Their Benefits in Thermal Processes", Ind. Heat., vol. 49, No. 8, pp. 49–52, (8/82), (abstract only).

Albert, M., "Ceramic Fiber Beats the Heat", Mod. Mach. Shop, vol. 54, No. 2, pp. 95–98, (7/81), (abstract only).

*Primary Examiner*—Peter D. Rosenberg

*Attorney, Agent, or Firm*—Robert A. Gerlach

[57] ABSTRACT

Sputtering targets and a method for preparing them by melting the components of a rare earth-transition metal alloy in an inert atmosphere in the inner section of a crucible assembly having inner and outer sections separating by thermally insulating material and cooling the melt in the inner section.

14 Claims, 2 Drawing Sheets

HIGH PURITY SPUTTERING TARGET MATERIAL AND METHOD FOR PREPARING HIGH PURITY SPUTTERING TARGET MATERIALS

BACKGROUND OF THE INVENTION

This invention relates to high purity substantially defect-free alloy sputtering target materials and more particularly, to rare earth-transition metal (RE-TM) sputtering targets useful for producing magnetooptical media, and a method for preparing them.

Conventionally, RE-TM sputtering targets are made by melting the component metals together in an inert atmosphere, for example in the crucible of an induction furnace. The melt is then poured from the crucible into a mold where it is cooled quickly to form an ingot. However, the presence of significant residual stresses in rapidly cooled castings and the brittle nature of RE-TM alloys make it difficult to prepare targets from such materials which are devoid of cracks, voids and other defects.

Generally, defects are minimized and yields are improved in conventional casting processes by maintaining the fluidity of the melt in the mold for an appreciable length of time before casting. However, superheating the melt to improve its fluidity before pouring will alter the alloy composition because of the high vapour pressure of the rare earth metals.

It is therefore an object of this invention to provide high purity substantially defect-free sputtering target materials and a method for making them which is devoid of the foregoing disadvantages.

SUMMARY OF THE INVENTION

The foregoing object and others which will become apparent from the following description are accomplished in accordance with the invention, generally speaking by providing RE-TM alloy sputtering materials which are substantially defect-free and produced by a method which comprises introducing the component of an RE-TM alloy into the inner section of a crucible assembly having an inner and outer section separated by thermally insulating material, melting the component by heating in an inert atmosphere to form an alloy melt, controlling the cooling of the melt in the crucible assembly, and solidifying the alloy.

The cruible assembly has an inner section comprised of a crucible, preferably a quartz crucible having a boron nitride coating or the crucible itself may be made of boron nitride. The outer section of the crucible assembly is a means for controlling the cooling and hence solidification of the alloy in the inner section. The outer section is preferably a second crucible larger than the inner crucible and spaced therefrom by a thermally insulating material, preferably by zirconium oxide spacers.

Because the RE-TM alloy is solidified under controlled conditions in the crucible in which it is prepared, improved yields of high purity alloy substantially devoid of cracks and voids are obtained. The present process also largely avoids the difficulties and disadvantages of conventional casting techniques, minimizing possible contamination of the alloy while consistently providing substantially defect free targets.

DETAILED DESCRIPTION OF THE INVENTION

Figure 2:
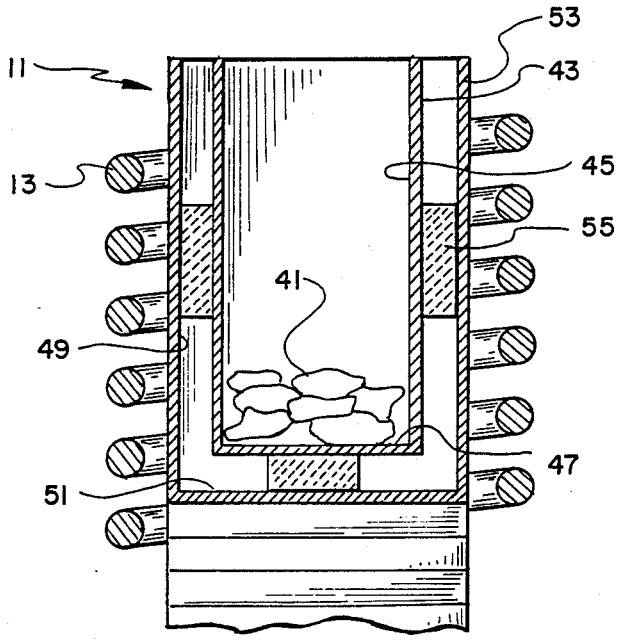
FIG. 2 is a diagram of a crucible assembly of the invention.

A crucible assembly 11 of the invention shown in FIG. 2 already contains the components of the RE-TM alloy in charge 41 in inner section or inner crucible 43. As shown, the inner crucible has inner circumferential side wall portion 45 and inner bottom wall portion 47 adapted to form, with the side wall, an inner crucible chamber. As shown, outer section or outer crucible 53 has a configuration similar to that of the inner crucible with outer circumferential side wall portion 49 and outer bottom wall portion 51 adapted to form, with the outer side wall, an outer crucible chamber within which the inner crucible chamger is supported by thermally stable insulating material 55. A lid or crucible cover 16 covers the mouth of inner crucible 43 and, preferably, of both inner crucible 43 and outer crucible 53.

Charge 41 is melted by induction heating in inner crucible 43 to produce an RE-TM alloy. Any suitable frequency depending on the size of the charge may be used. Low frequency induction heating is preferred since low frequency coil current creates a magnetic field in the charge which causes mechanical mixing of the components in the crucible.

since inner crucible 43 also acts as a mold for the alloy, the inner crucible can have any configuration which will produce a sputtering target of the desired shape. The outer crucible may have the same or different shape as desired.

Inner crucible 43 can be made of any material suitable for retaining rare earth and transition metal allloys while they are being heated as well as during solidification to form ingots. Preferably, the inner crucible is made up of boron nitride or boron nitrude-coated quartz. Boron nitrude is non-reactive to rare earth metals, transition metals, and alloys thereof at high temperature and will neither contaminate or introduce impurities into the alloy. This is particularly important since the inner crucible also acts as a mold during solidification of the alloy melt. Any other material non-reactive to rare earth, transition metals, or alloys thereof at the temperatures used for induction heating to form the alloy can also be employed. While the outer crucible is preferably quartz, any other material which can withstand rapid heating and cooling cycles with good mechanical strength can be used. Generally, any material that can provide predictable controlled cooling with good thermal shock resistance can be used including amorphous silicon oxide, fused quartz, alumina, high strength ceramics, and the like.

The temperatures at which the components are heated to form the RE-TM alloy range from about 1200° C. to 1700° C., preferably 1500° C. and most preferably at about 200° C. above the melting temperature of the alloy.

To facilitate predictable controlled cooling, inner crucible 43 is substantially surrounded by outer crucible 53 and separated therefrom by a thermally insulating material. Generally, the crucibles are concentric, open at the top and at least the inner crucible is lidded. Preferably, however, a lid or crucible cover 16 is used which will cover both inner crucible 43 and outer crucible 53.

For best results, the crucible walls should be as thick as possible consistent with coil design and the practicalities of the system. Generally, a thickness of from two to five millimeters is employed. The crucibles can have the same or different wall thicknesses consistent with the design of the system.

Predictable controlled cooling which prevents thermal shock requires slow and uniform transfer of heat out of the melt. This is controlled in part by the spacing between the crucibles. The outer crucible should surround the inner crucible with a space therebetween of from about 2 to about 10 mm, preferably 5 mm. While the space between the sides and bottom of the inner and outer sections of the crucible need not be uniform,, for best results, a spacing of about 5 mm should be maintained.

Any thermally insulating material which will not interfere with the predictable controlled cooling of the RE-TM alloy can be used as a spacer between the inner and outer crucibles. Any low thermal conductivity material can be used as the insulating spacer, preferably one having a thermal conductivity of 2 watts/m/° C. The thermally insulating material should be capable of withstanding temperatures greater than about 1500° C. and should have a thermal expansion coefficient consistent with that of the crucible assembly, preferably approximately the same. Some suitable thermally insulating materials which can be used include zirconium oxide, aluminum oxide, beryllium oxide, yttrium oxide, magnesium oxide, and the like. Zirconium oxide is preferred for its low thermal conductivity, preferably in the form of felted zirconia fibers.

Thermally insulating material in the form of spacers as shown at 55 in FIG. 2 provides slower cooling and is therefeore preferred to a solid insulating material layer. The spacers can have any area which may be convenient, preferably 1–5 square centimeters and preferably three or four are employed to provide a total area of from about 5–25 square centimeters. The width is determined by the difference in dimension between the exterior of the inner section and the interior of the outer section of the crucible assembly.

Figure 1:
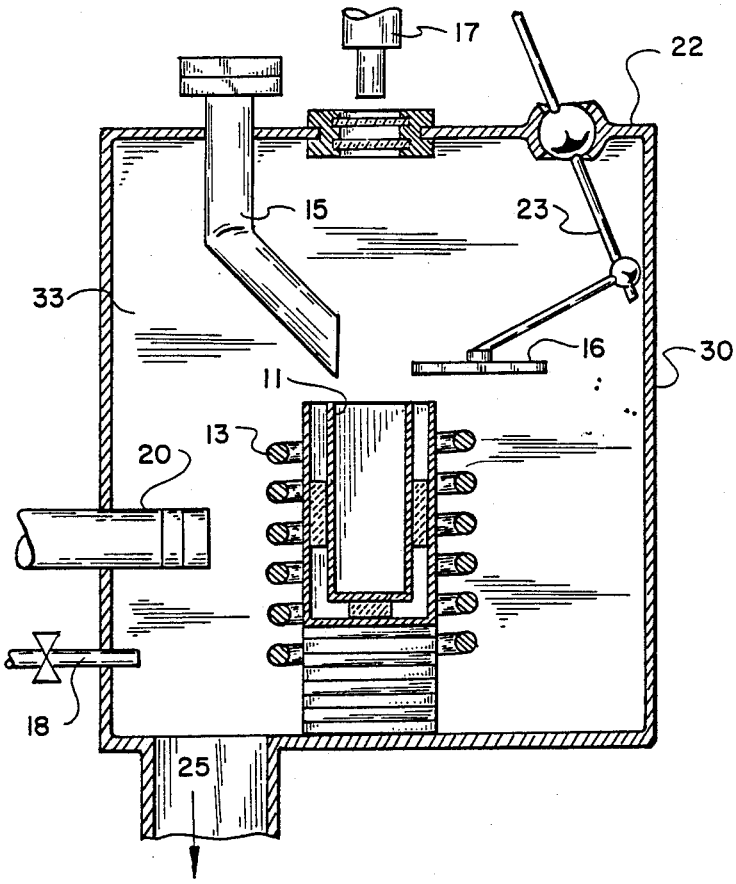
FIG. 1 is a schematic of an induction melting furnace which may be used to melt the components of the alloy in the practice of the invention.

Any suitable apparatus adapted to melt metals by low-induction heating in the crucible assembly of this invention can be used in the practice of the invention. For example, the apparatus shown schematically in FIG. 1 is an induction melting furnace 30 in which crucible assembly 11 is disposed inside induction coil 13 connected to low frequency generator 20. Crucible cover 16 is disposed at the end of arm assembly 23 extending through roof 22 of furnace 30. Port 25 is connected to evacuating means for chamber 33, preferably a vacuum pump. Inert gas is introduced into evacuated chamber 33 via inlet 18. Chute or bucket 15 introduces the charge to crucible assembly 11. Any suitable temperature sensing element 17 can be used, preferably an optical pyrometer.

Any suitable pressures can be employed during heating of the charge in the crucible assembly and a range of from about 100 Torr to about 1000 Torr in a gas atmosphere inert to the components of the alloy and the alloy itself (inert gas) is recommended. Preferably, a high vacuum of 10 to 80 milliTorr, preferably 50 milliTorr, is used during cooling.

The charge can comprise any suitable rare earth metal such as Gd, Md, Pr, Ce, Tb, Dy, Ho, Sm, Yb, Tm, La, Y and the like and mixtures thereof and any suitable transition metal such as Fe, Co, Mn, Ni, Ta, Hf, Ti, V, Cr, Zr, Pt, and the like and mixtures thereof. The metals should have high purity, typically 99.9%, and a low oxygen content, at most 0.1%. Any suitable ratio of the rare earth metal or metals to the transition metal or metals can be employed as is known in the art to produce the desired sputtering target composition. Preferably, 10 to 40 at.% of the rare earth metal to 60 to 90 at .% of the transition metal is used. Most preferably, a TbFe or TbFeCo mixture is used as described in U.S. Pat. No. 4,670,353, the disclosure of which is hereby incorporated by reference.

In a preferred method of practicing the invention, before the change is melted, the system or chamber 33 is evacuated through port 25 to a low pressure, generally $5\times10^{-5}$ to $5\times10^{-1}$ Torr, preferably $5\times10^{-2}$ Torr, and backfilled with a gas inert to the components of the charge and the alloy to be produced therefrom at a pressure of $10^{-5}$ to $10^{6}$ Torr. Any suitable inert gas known in the art can be used such as, for example, substantially oxygen-free argon, helium, xenon, neon and the like and mixtures thereof. Argon is preferred.

The charge is melted in the crucible assembly and heated until a temperature 200° C. above the melting point of the alloy is achieved. Heating is continued at that temperature for five to ten minutes or until the melt becomes homogeneous due to electromagnetic stirring associated with induction melting. The system is then evacuated to a pressure as low as practicable to avoid evaporation of materials at the temperature of the melt, for example at 10–80 milliTorr, preferably 50 milliTorr, and the power to the coil is turned off. Because of the low thermal conductivity of the crucible assembly, heat dissipates from the metl very slowly and the melt cools at a slow and uniform rate. Thermal controlled cooling from 1200° C. down to about 300° C. takes place at an observed rate of 37° C./minute.

When the alloy has cooled and solidified, it is removed from the mold and can be used as a sputtering target.

Sputtering targets prepared by the process of the invention using the crucible assembly of the invention are crack free and sound, homogeneous in composition, and characterized by a fine grain structure. Depending on the size and configuration of the inner section of the crucible assembly, targets of various shapes and dimensions can be produced having reasonably flat top and bottom surfaces which can easily be polished to make them suitable for use as sputtering targets. Using crucible assemblies of suitable dimension, homogeneous sputtering targets having diameters of 2–4 inches and thicknesses of 0.5–1 inch and a fine grain structure have been produced.

The invention is further illustrated but is not intended to be limited by the following examples in which all parts and percentages are by weight unless otherwise specified.

EXAMPLES

A target material having a diameter of 51 mm, a thickness of 5 mm and the composition Tb, 24 at%; Fe, 71 at%; and Co, 5 at% is prepared as follows:

The interior of a fused quartz crucible having a 51 mm inside diameter, a 55 mm outside diameter and a length of 150 mm was coated with a thin layer of boron nitride by spraying. The coated crucible is dired at ambient conditions for ten minutes and then heated at 450° C. at atmospheric pressure for thirty minutes to evaporate any moisture contained in the boron nitride spray. The crucible thus prepared is surrounded by a second crucible of fused quartz having an inside diameter of 60 mm, an outside diameter of 66 mm, and a length of 150 mm. Four zirconia felt spacers each 2 $cm^2$ and 2.5 mm thick were interposed between the inner and outer crucible and the crucible assembly was inserted into the coil of an induction furnace.

A 163,72 gram charge containing 77.34 g Tb, 80.4 g Fe, and 5.98 g Co with a purity of 99.9% was placed in the inner crucible. The furnace chamber was evacuated below 10 milliTorr and backfilled with argon. The chamber was then evacuated to 10 milliTorr and brought to 1000 Torr with argon before turning on the power. The charge was then heated to 1500° C. (about 200° C. above 1300° C., the melting temperature of the alloy). The charge was maintained at 1500° C. for 10 minutes until the alloy became homogeneous.

Figure 3:
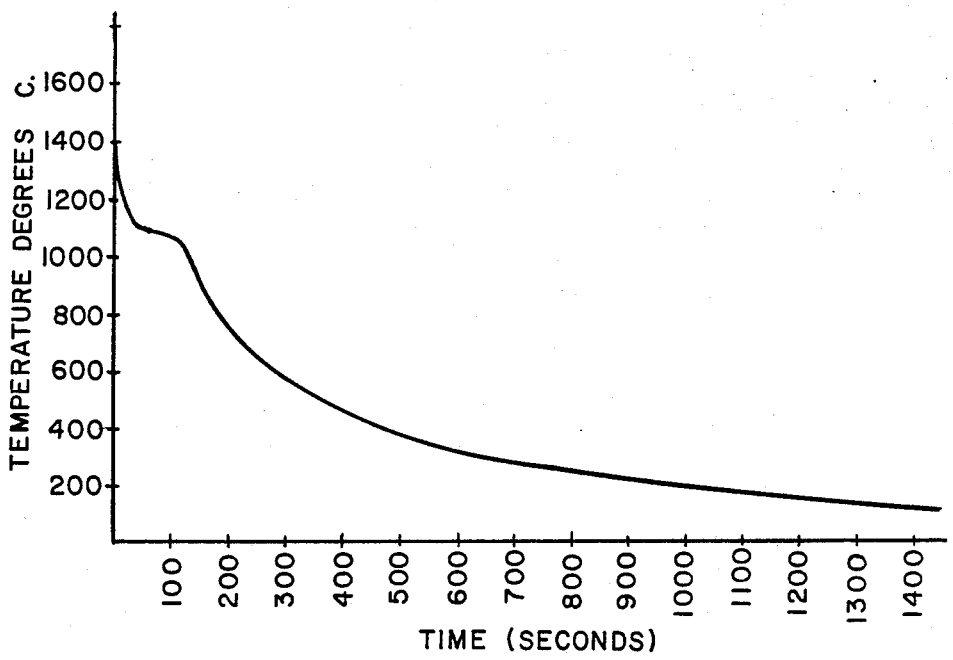
FIG. 3 is a typical cooling curve for a preferred target material of the invention.

The chamber is then evacuated to 50 milliTorr pressure after which the power to the furnace is turned off and the alloy cools slowly and uniformly in the inner crucible. The cooling rate of the alloy was measured by a two color pyrometer mounted in the top of the furnace and focused on the melt. FIG. 3 shows the cooling curve derived from the measurements taken. The cooling rate as measured from 1200° C. to 300° C. was found to be 37° C./minute. The target was removed from the vacuum chamber when it had cooled to about 200° C. and examined. The target was a single piece having a 51 mm diameter and exhibited no cracks on either its upper and lower surfaces.

The surfaces of the target thus produced were polish cleaned using 240, 320, 400, and 600 grit emery papers and then with 10 micron aluminum oxide paste. The composition of the alloy measured by inductively coupled plasma spectroscopy on small pieces scooped from the target surface 4 was Tb: 24.5±0.5 at%; Fe: 70.6±1.5 at%; and Co: 4.9±0.2 at%. Oxygen content measured by neutron activation analysis was less than 200 ppm.

An optical micrograph taken from the top surface of a small section cut from the target and polished showed a typical dendritic structure of the alloy. Average size of the dendrite is 70 microns long and 10 microns wide. Samples taken from different partys of the target show a similar microstructure.

Phase analysis of the target alloy carried out using powder X-ray diffraction techniques indicate that the major phases in the alloy are cubic and rhombohedral.

Finally, the target was analyzed for compositional homogeneity and microstructure by Scanning Electron Microscopy. SEM indicated that the dendritic phase has a $PuNi_3$ type rhombohedral phase and the matrix has a $MgCu_2$ type cubic phase uniformly distributed throughout the entire target. Thus, a target prepared by this invention has compositional homogeniety on a micron scale.

Figure 4:
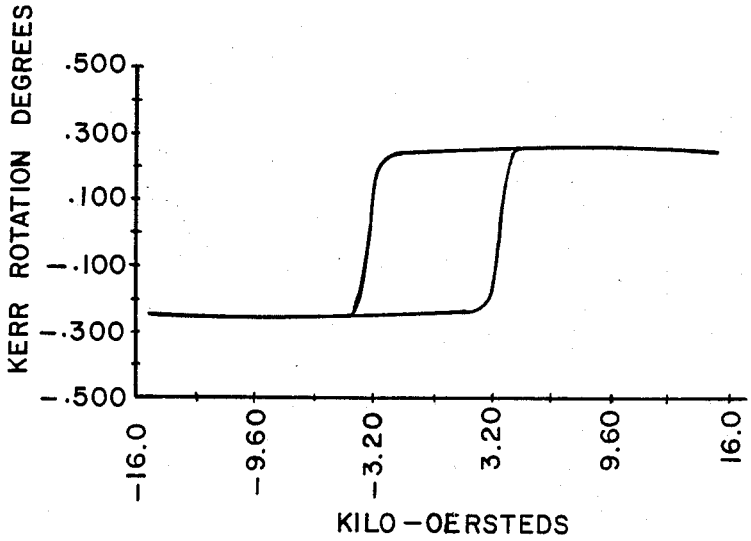
FIG. 4 is Kerr hysteresis loop for a thin film sputtered from a preferred alloy target.

Another target prepared as described above was used to prepare thin films by DC magnetron sputtering. Thin films with good compositional homogenity and magnetooptical properties were obtained. FIG. 4 shows the Kerr hysteresis loop obtained from the film sputtered from the target prepared. The square loop indicates that the oxygen content of the film is very low, thus confirming the high purity of the target materials produced by the practice of the invention.

Although the invention has been described in considerable detail in the foregoing, such detail is solely for the purpose of illustration. Variations can be made in the invention by those skilled in the art without departing from the spirit and scope of the invention except as set forth in the claims.

What is claimed is:

1. A method for producing rare earth-transition metal sputtering target materials which comprises introducing the components of a rare earth-transition metal alloy into the inner section of a crucible assembly having an inner and outer section separated by thermally insulating material, melting the components in an inert atmosphere to form an alloy melt, controlling the cooling of the melt in the crucible assembly, and solidifying the alloy to form the target.

2. The method of claim 1 wherein the alloy is a TbFe or TbFeCo mixture.

3. The method of claim 1 wherein the components of the alloy are induction heated at a temperature of from 1200° C. to 1700° C.

4. The method of claim 3 wherein the temperature is 200° C. above the melting temperature of the alloy.

5. The method of claim 1 wherein the inert atmosphere is argon, helium, xenon, neon or mixtures thereof.

6. The method of claim 5 wherein the inert atmosphere is argon.

7. The method of claim 3 wherein the components are heated at 100–1000 Torr of inert gas pressure.

8. The method of claim 1 wherein the alloy is cooled at 10–80 milliTorr of inert gas pressure.

9. The method of claim 1 wherein the inner section has the internal configuration of the sputtering target to be produced.

10. The method of claim 9 wherein the inner section is a boron nitride or boron nitride-coated quartz crucible.

11. The method of claim 1 wherein the outer crucible is quartz.

12. The method of claim 1 wherein the space between the crucibles is from 2 to 10 mm.

13. The method of claim 1 wherein the space is 5 mm.

14. The method of claim 1 wherein the thermally insulating material comprises spacers of felted zirconium oxide.

* * * * *